US008979140B2

(12) United States Patent
Tien

(10) Patent No.: US 8,979,140 B2
(45) Date of Patent: Mar. 17, 2015

(54) LATCH WITH AN AUTOMATIC LOCKING FUNCTION FOR A DOUBLE DOOR

(71) Applicant: I-Tek Metal Mfg. Co., Ltd., Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 242 days.

(21) Appl. No.: 13/794,934

(22) Filed: Mar. 12, 2013

(65) Prior Publication Data

US 2014/0265355 A1 Sep. 18, 2014

(51) Int. Cl.
*E05B 65/10* (2006.01)
*E05C 1/08* (2006.01)

(52) U.S. Cl.
CPC ..... *E05B 65/104* (2013.01); *E05C 1/08* (2013.01); *Y10S 292/04* (2013.01); *Y10S 292/21* (2013.01)
USPC ..... 292/92; 292/DIG. 4; 292/DIG. 21

(58) Field of Classification Search
CPC ..... E05B 65/104; E05B 65/1006; E05B 65/1013; E05C 1/08; E05C 7/045; E05C 9/04; E05C 9/042
USPC ..... 292/21, 92–94, 137, 138, 163, 177, 292/143, DIG. 4, DIG. 21
See application file for complete search history.

(56) References Cited

U.S. PATENT DOCUMENTS

| | | | | |
|---|---|---|---|---|
| 6,409,231 | B1 * | 6/2002 | Rusiana | 292/33 |
| 6,820,905 | B1 * | 11/2004 | Haeck et al. | 292/93 |
| 6,883,837 | B1 * | 4/2005 | Lin | 292/33 |
| 2009/0051172 | A1 * | 2/2009 | Yu et al. | 292/198 |
| 2010/0259052 | A1 * | 10/2010 | Lin | 292/56 |

FOREIGN PATENT DOCUMENTS

FR 2839895 A1 * 11/2003

* cited by examiner

*Primary Examiner* — Kristina Fulton
*Assistant Examiner* — Christine M Mills
(74) *Attorney, Agent, or Firm* — Alan D. Kamrath; Kamrath IP Lawfirm, P.A.

(57) ABSTRACT

A latch assembly includes a latch having a body. A stop having a lower melting point is received in an engagement hole of the body. An ear is pivotable between a storage position in a transverse groove of the body and a blocking position partially extending out of the transverse groove. A pressing pin is slideably received in a longitudinal hole in the body. The ear is located in the storage position when the pressing pin is in a non-pressing position, allowing pivotable movement of the latch between a latching position and an unlatching position. When the latch is in the latching position and the ear is in the storage position, if the stop is melted by heat, the pressing pin is moved from the non-pressing position to the pressing position and pivots the ear to the blocking position, retaining the latch in the latching position.

8 Claims, 12 Drawing Sheets

LATCH WITH AN AUTOMATIC LOCKING FUNCTION FOR A DOUBLE DOOR

BACKGROUND OF THE INVENTION

The present invention relates to a latch for a latch assembly and, more particularly, to a latch for a latch assembly for a double door, providing an automatic locking function while closing a follower door of the double door.

A double door generally includes a primary door and a follower door pivotably mounted to two vertical beams of a door frame. A lock is mounted to the primary door and includes a handle on a side of the primary door and a first latch on an end face of the primary door. The first latch can be retracted into the primary door upon pivotal movement of the handle. Upper and lower latch assemblies are mounted to upper and lower ends of the follower door. The upper latch assembly includes an actuation latch extending beyond an end face of the follower door and a second latch normally extending beyond an upper face of the follower door. The lower latch assembly includes an actuation latch extending beyond the end face of the follower door and a third latch normally extending beyond a bottom face of the follower door. When the follower door is moving from an open position to a closed position, each of the second and third latches is moved from an extended, latching position to a retracted, unlatching position. When the follower door is in the closed position, the second latch is engaged in a groove in the door frame, and the third latch is engaged in a groove in the ground, locking the follower door. Since the first latch of the lock on the primary door is engaged with a receptacle in the follower door, the primary door can not be opened, either. Thus, the double door can be reliably locked. However, if the primary door is closed while the follower door is not completely closed (namely, the second latch is not aligned with the groove in the door frame, and the third latch is not aligned with the groove in the ground), the second and third latches can not be moved to the exact latching positions, leading to damage to the upper and lower latch assemblies. Furthermore, the first, second, and third latches may be deformed by the heat during a fire and, thus, moved to the unlatching position, leading to the risks of opening of the double door and spread of the fire.

Thus, a need exists for a latch assembly providing an automatic locking function for a double door.

BRIEF SUMMARY OF THE INVENTION

The present invention solves this need and other problems in the field of reliable locking of a double door by providing, in a first aspect, a latch for a latch assembly including a body having a locking end and an engagement end spaced from the locking end along a first axis. The engagement end of the body is adapted to engage with a connecting rod of a latch assembly. The body further includes a transverse groove extending along a second axis perpendicular to the first axis. The body further includes a face extending between the locking end and the engagement end. An engagement hole extends from the face of the body to the transverse groove. The body further includes a longitudinal hole extending from the engagement end to the transverse groove. The latch is movable along the first axis between a latching position and an unlatching position. The locking end of the latch in the unlatching position is adapted to be received in a door. The locking end of the latch in the latching position is adapted to extend out of the door into a groove in a door frame or the ground. A stop is made of a material having a melting point lower than a melting point of the body of the latch. The stop is received in the engagement hole of the body. A first ear is pivotably received in the transverse groove of the body. The first ear includes first and second ends spaced from each other along the first axis. The first ear further includes an inner side extending between the first and second ends. The first ear is pivotable between a storage position in the transverse groove and a blocking position partially extending out of the transverse groove. A pressing pin is received in the longitudinal hole and slideable along the first axis between a pressing position and a non-pressing position. A spring is mounted in the longitudinal hole. The spring biases the pressing pin to press against the inner side of the first ear and biasing the pressing pin from the non-pressing position to the pressing position.

When the first ear is in the storage position and the pressing pin is in the non-pressing position, the latch is pivotable between the latching and unlatching positions. When the latch is in the latching position and the first ear is in the storage position, if the stop is melted by heat, the pressing pin is moved by the spring from the non-pressing position to the pressing position and presses against the inner side of the first ear to pivot the first ear from the storage position to the blocking position, retaining the latch in the latching position.

In an embodiment, a second ear is pivotably received in the transverse groove of the body. The second ear includes first and second ends spaced from each other along the first axis. The second ear further includes an inner side extending between the first and second ends of the second ear. The second ear is pivotable between a storage position in the transverse groove and a blocking position partially extending out of the transverse groove. Each of the first and second ears further includes a coupling groove in the inner side thereof. The coupling groove has a limiting face. The coupling groove of the first ear divides the inner side of the first ear into a stop portion and a push portion. The coupling groove of the second ear divides the inner side of the second ear into a stop portion and a push portion.

When the first and second ears are in the storage positions and the pressing pin is in the non-pressing position, an outer end of the pressing pin presses against the push portions of the first and second ears, and the stop is sandwiched between and pressed against by the stop portions of the first and second ears.

When the first and second ears are in the blocking positions, the stop portions of the first and second ears press against each other, and the outer end of the pressing pin is received in the coupling grooves of the first and second ears. The limiting faces of the first and second ears press against the outer end of the pressing pin, preventing the first and second ears from pivoting from the blocking positions to the storage positions.

In a second aspect, a latch assembly includes a base having two sidewalls and an intermediate wall extending between the sidewalls. Each sidewall includes a movement groove and first and second engagement holes. The movement groove is located between the first engagement hole and the second engagement hole along a first axis. The intermediate wall includes a slot. The intermediate wall of the base is adapted to be mounted to an end face of a follower door of a double door. The sidewalls are adapted to be received in an interior space of the follower door. The follower door is pivotable between a closed position and an open position.

A movable member is movably received between the sidewalls of the base. The movable member includes two lateral walls spaced from each other along a second axis perpendicular to the first axis. The movable member further includes a connecting portion extending between the lateral walls. Each lateral wall includes a first end and a second end spaced from the first end along the first axis. First and second sliding grooves are defined in each lateral wall. The first sliding groove is located between the second sliding groove and the connecting portion along a third axis perpendicular to the first and second axes. The movement grooves of the sidewalls of the base are aligned with the first sliding grooves of the lateral walls of the movable member.

A first pin extends through the movement grooves of the sidewalls of the base and the first sliding grooves of the lateral walls of the movable member. A second pin extends through the first engagement holes of the sidewalls of the base and the second sliding grooves of the lateral walls of the movable member. The movable member is movable between an engagement position and a disengagement position along the first axis.

A follower is pivotably connected to the movable member. The follower includes an arm having first and second ends. The first pin extends through the first end of the arm, allowing the follower to pivot about a pivot axis defined by the first pin. An actuation member is pivotably received in the base and has first and second ends and a pivotal portion between the first and second ends of the actuation member. The second end of the actuation member faces the intermediate wall of the base.

A locking block is mounted between the lateral walls of the movable member. The locking block and the movable member are jointly movable between the disengagement position and the engagement position. A first spring is mounted between the locking block and the first pin. The first spring biases the locking block and the first pin away from each other along the first axis.

A limiting frame is fixed between the sidewalls of the base. The limiting frame includes a first wall and a second wall spaced from the first wall along the first axis. The limiting frame further includes a connecting wall extending between the first and second walls. The first wall includes an inner face and an outer face spaced from the inner face along the first axis. A slot extends from the inner face through the outer face of the first wall. The first and second walls are fixed to the intermediate wall of the base. The second end of the actuation member extends through the slot and is received between the first and second walls.

An actuation latch is movably received in the slot of the base. The actuation latch includes a base portion having first and second ends spaced from each other along the third axis. A wedge is formed on the second end of the actuation latch and has two actuation faces. The actuation latch is movable along the third axis between a releasing position in which the wedge is located outside of the base and a pressing position in which the wedge is received in the base. The actuation latch is adapted to be actuated by an end face of a primary door of the double door. When the follower door is in the closed position and the end face of the primary door is aligned with the end face of the follower door, the end face of the primary door presses against the actuation latch, moving the actuation latch from the releasing position to the pressing position.

A connecting rod includes a first end engaged with the locking block and a second end. A latch includes a body having a locking end and an engagement end spaced from the locking end along the first axis. The engagement end of the latch is engaged with the second end of the connecting rod. The body further includes a transverse groove extending along the second axis perpendicular to the first axis. The body further includes a face extending between the locking end and the engagement end. An engagement hole extends from the face of the body to the transverse groove. The body further includes a longitudinal hole extending from the engagement end to the transverse groove. The latch is movable along the first axis between a latching position and an unlatching position. The locking end of the latch in the unlatching position is adapted to be received in the follower door. The locking end of the latch in the latching position is adapted to extend out of the follower door into a groove in a door frame or the ground.

The latch further includes a stop made of a material having a melting point lower than a melting point of the body of the latch. The stop is received in the engagement hole of the body. A first ear is pivotably received in the transverse groove of the body. The first ear includes first and second ends spaced from each other along the first axis. The first ear further includes an inner side extending between the first and second ends. The first ear is pivotable between a storage position in the transverse groove and a blocking position partially extending out of the transverse groove. A pressing pin is received in the longitudinal hole and slideable along the first axis between a pressing position and a non-pressing position. A second spring is mounted in the longitudinal hole. The second spring biases the pressing pin to press against the inner side of the first ear and biases the pressing pin from the non-pressing position to the pressing position.

When first ear is in the storage position and the pressing pin is in the non-pressing position, the latch is pivotable between the latching and unlatching positions.

When the latch is in the latching position and the first ear is in the storage position, if the stop is melted by heat, the pressing pin is moved by the second spring from the non-pressing position to the pressing position and presses against the inner side of the first ear to pivot the first ear from the storage position to the blocking position, retaining the latch in the latching position.

When the follower door is in the open position, the latch is not aligned with the groove in the door frame or ground. When the follower door is in the closed position, the latch is aligned with the groove in the door frame or ground.

When the actuation latch is in the releasing position, the movable member is in the disengagement position, and the latch is in the unlatching position.

When the follower door is in the closed position and the actuation latch moves from the releasing position to the pressing position, the first end of the actuation latch pushes the second end of the actuation member to move the second end of the follower, causing the first pin to push the locking block via the first spring, moving the movable member from the disengagement position to the engagement position while pulling the first spring, thereby moving the locking end of the latch to the latching position to engage with the groove in the door frame or ground.

When the actuation latch is moved from the releasing position to the pressing position while the follower door is not in the closed position, the actuation member actuates the follower via the push pin, moving the first pin in the movement grooves of the base along the first axis and compressing the first spring, retaining the movable member in the disengagement position and retaining the latch in the unlatching position to avoid damage to the latch assembly.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
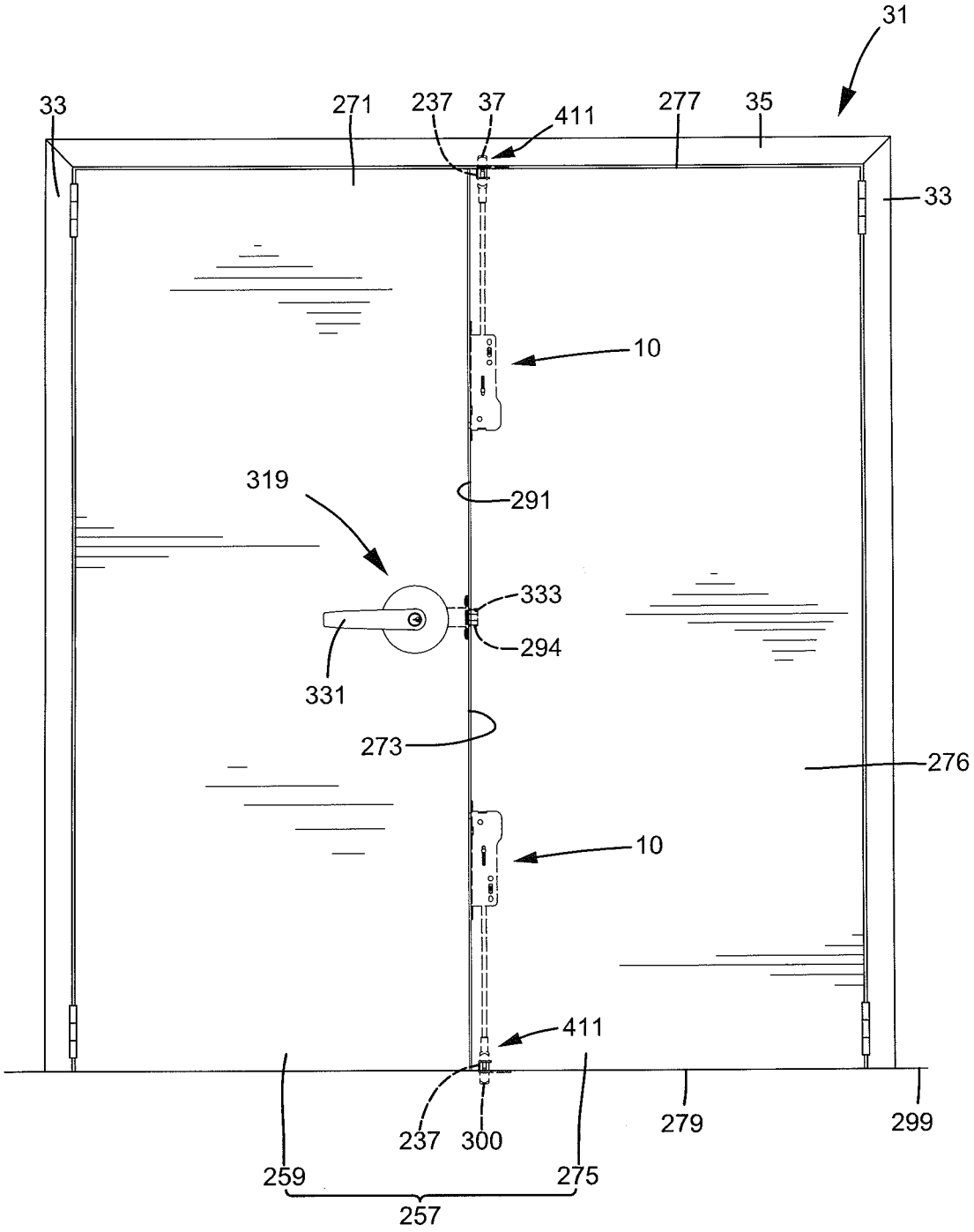
FIG. 1 shows a diagrammatic front view of a double door to which two latch assemblies according to the present invention is mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "top", "bottom", "inner", "outer", "end", "portion", "section", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a double door 257 mounted to a door frame 31 on a floor or ground 299. Door frame 31 includes two spaced vertical beams 33 on ground 299 and a top beam 35 extending between upper ends of vertical beams 33. Top beam 35 includes a bottom side having a groove 37. A groove 300 is defined in ground 299 and aligned with groove 37 of top beam 35.

In the form shown, double door 257 includes a primary door 259 pivotably mounted to one of vertical beams 33 and a follower door 275 pivotably mounted to the other vertical beam 33. Follower door 275 includes an interior space 293. Primary door 259 includes two sides 271 and an end face 273 extending between sides 271 and extending perpendicularly to ground 299. Follower door 275 includes two sides 276, a top face 277 extending between sides 276 and facing top beam 35, and a bottom face 279 extending between sides 276 and facing ground 299. Each of top face 277 and bottom face 279 includes a mounting hole 295 in communication with interior space 293. Follower door 275 further includes an end face 291 extending between sides 276 and between top and bottom faces 277 and 279. Two engagement holes 297 are defined in end face 291 of follower door 275 and spaced from each other along a first axis X perpendicular to ground 299. A receptacle 294 is defined in end face 291 and located intermediate engagement holes 297.

Follower door 275 is pivotable about an axis parallel to first axis X between an open position and a closed position. When follower door 275 is in the open position, mounting holes 295 are not aligned with grooves 37 and 300. When follower door 275 is in the closed position, mounting hole 295 in top face 277 is aligned with groove 37, and mounting hole 295 in bottom face 279 is aligned with groove 300 in ground 299.

A door lock 319 is mounted to primary door 259. Door lock 319 can be of any desired form as conventional including but not limited to of a commercially available type. In the form shown, door lock 319 includes a latch 333 and a handle 331 operatively connected to latch 333. Handle 331 is located on one of sides 271 of primary door 259. Pivotal movement of handle 331 causes movement of latch 333 from an extended position outside of end face 273 of primary door 259 to a retracted position inside of primary door 259. When follower door 275 is in the closed position, end face 273 of primary door 259 is aligned with end face 291 of follower door 275, with a gap existed between end faces 273 and 291, and with latch 333 engaged in receptacle 294 of follower door 275.

Figure 4:
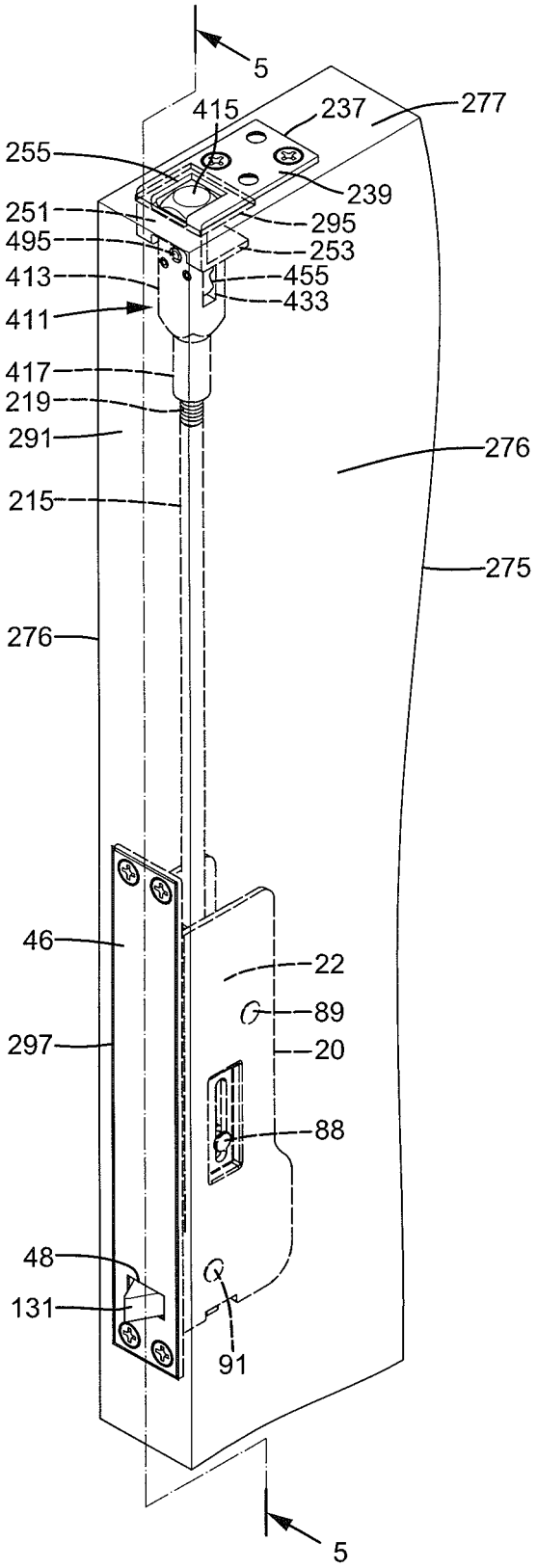
FIG. 4 shows a partial, perspective view of the double door of FIG. 1.

According to the form shown, upper and lower coupling members 237 are respectively mounted in mounting holes 295 of follower door 275 (FIG. 4). Each of upper and lower coupling members 237 includes a first portion 239, a second portion 251, and a third portion 253. Second portion 251 extends perpendicularly to an end of first portion 239 and an end of third portion 253, with first and third portions 239 and 253 parallel to and spaced from each other along first axis X. A receiving hole 255 is defined in each of first and third portions 239 and 253, with receiving hole 255 of first portion 239 aligned with receiving hole 255 of third portion 253. First portion 239 of upper coupling member 237 is fixed to top face 277 of follower door 275, with second and third portions 251 and 253 of upper coupling member 237 extending through mounting hole 295 into interior space 293 of follower door 275. First portion 239 of lower coupling member 237 is fixed to bottom face 279 of follower door 275, with second and third portions 251 and 253 of lower coupling member 237 extending through mounting hole 295 into interior space 293 of follower door 275.

Figure 2:
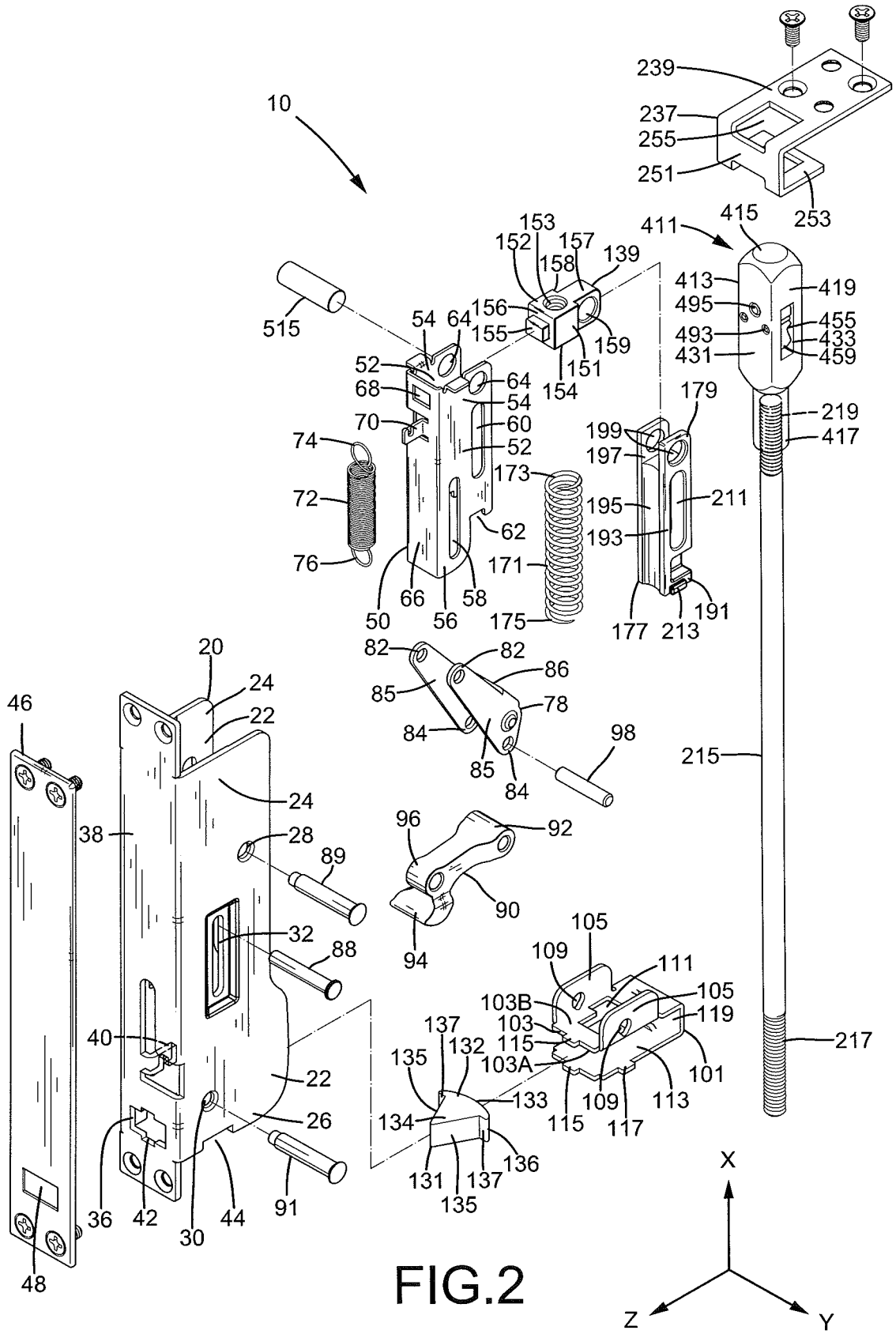
FIG. 2 shows an exploded, perspective view of one of the latch assemblies of FIG. 1.
Figure 3:
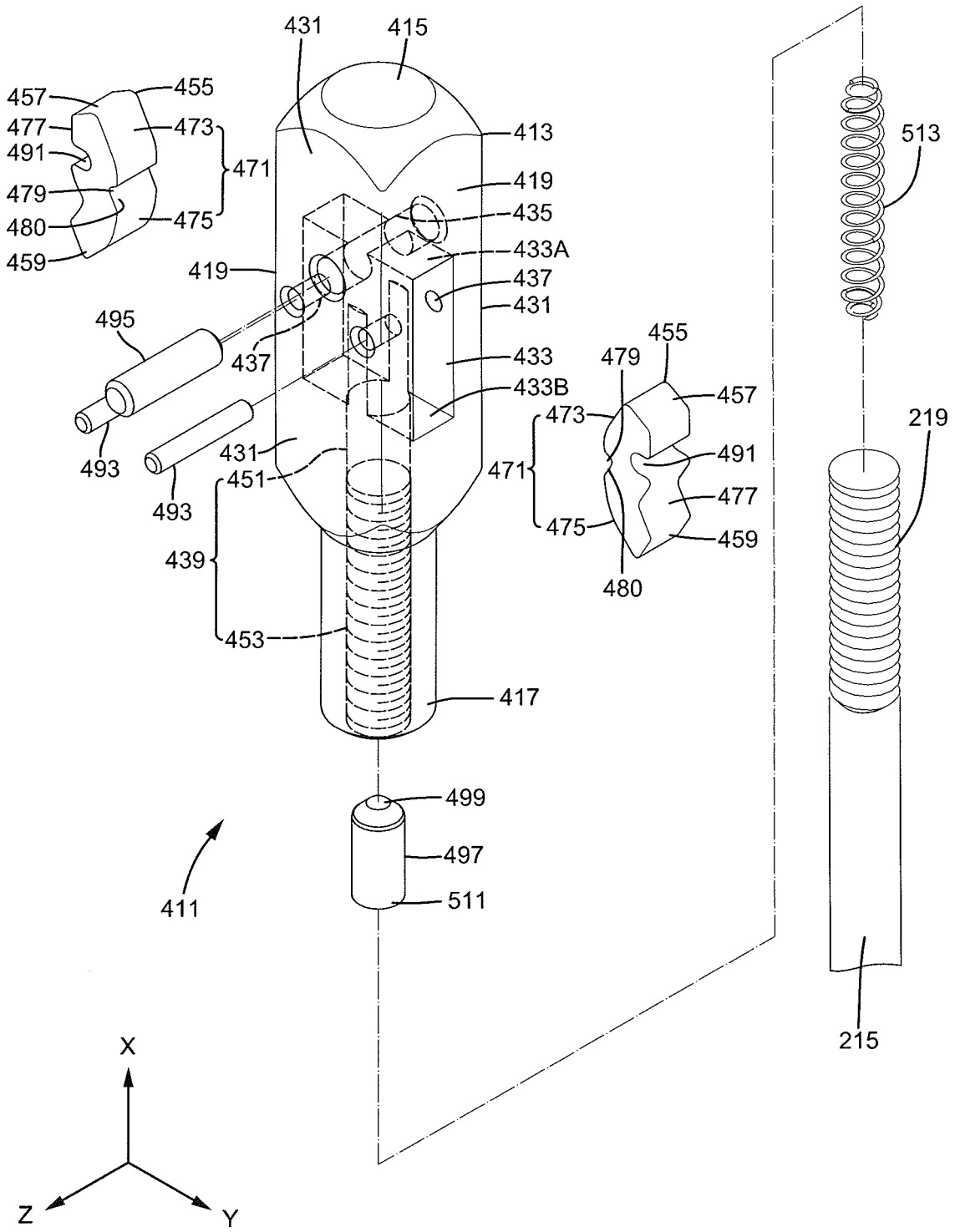
FIG. 3 shows an exploded, perspective view of a latch of the latch assembly of FIG. 2.

In the form shown, two latch assemblies 10 are mounted in locations respectively adjacent to top and bottom faces 277 and 279 of follower door 275 and arranged in a symmetric manner relative to a horizontal plane that is perpendicular to first axis X, with receptacle 294 and latch 333 located in the horizontal plane. Each latch assembly 10 includes a base 20 (FIG. 2) having two sidewalls 22 spaced along a second axis Y perpendicular to first axis X and an intermediate wall 38 extending between sidewalls 22. Each sidewall 22 includes a first end 24 and a second end 26 spaced from first end 24 along first axis X. Each sidewall 22 further includes a movement groove 32 located between first and second ends 24 and 26, a first engagement hole 28 located between first end 24 and movement groove 32, and a second engagement hole 30 located in second end 26. A slot 36 is defined in intermediate wall 38 and adjacent to second end 26 of each sidewall 22. Slot 36 includes two edges spaced along first axis X, with a first engagement groove 42 defined in each edge of first slot 36. Each sidewall 22 further includes a second engagement groove 44 in second end 26. A hooked portion 40 is formed on intermediate wall 38 and located between movement groove 32 and slot 36 along first axis X and located in a space defined by sidewalls 22 and intermediate wall 38.

In the form shown, a faceplate 46 is mounted to intermediate wall 38 and includes an opening 48 aligned with slot 36. Screws are extended through faceplate 46 and intermediate wall 38 into end face 291 of follower door 275. Intermediate wall 38 of base 20 and faceplate 46 of each latch assembly 10 are engaged in one of engagement holes 297 of follower door 275 (FIGS. 4 and 5), with sidewalls 22 received in interior space 293 of follower door 275, with first end 24 of each sidewall 22 of an upper one of latch assemblies 10 facing top beam 35, and with first end 24 of each sidewall 22 of a lower one of latch assemblies 10 facing ground 299 (FIG. 1).

According to the form shown, each latch assembly 10 further includes a movable member 50 movably received between sidewalls 22 of base 20. Movable member 50 includes two lateral walls 52 spaced from each other along second axis Y and a connecting portion 66 extending between lateral walls 52. Each lateral wall 52 includes a first end 54 and a second end 56 spaced from first end 54 along first axis X. Each lateral wall 52 further includes a first sliding groove 58 adjacent to second end 56 and a second sliding groove 60 adjacent to first end 54, with first sliding groove 58 located between second sliding groove 60 and connecting portion 66 along a third axis Z perpendicular to first and second axes X and Y. Each lateral wall 52 further includes a mounting hole 64 in first end 54 and an engagement notch 62 in second end 56. Connecting portion 66 includes a lug 70 adjacent to first end 54 of each lateral wall 52 and an engagement slot 68, with lug 70 located between second end 56 of lateral wall 52 and engagement slot 68. Lateral walls 52 of movable member 50 are received between sidewalls 22 of base 20, with first sliding grooves 58 of lateral walls 52 aligned with movement grooves 32 of sidewalls 22, with first engagement holes 28 of sidewalls 22 aligned with second sliding grooves 60 of lateral walls 52, with connecting portion 66 facing intermediate wall 38, and with lug 70 spaced from hooked portion 40 along first axis X.

Figure 8:
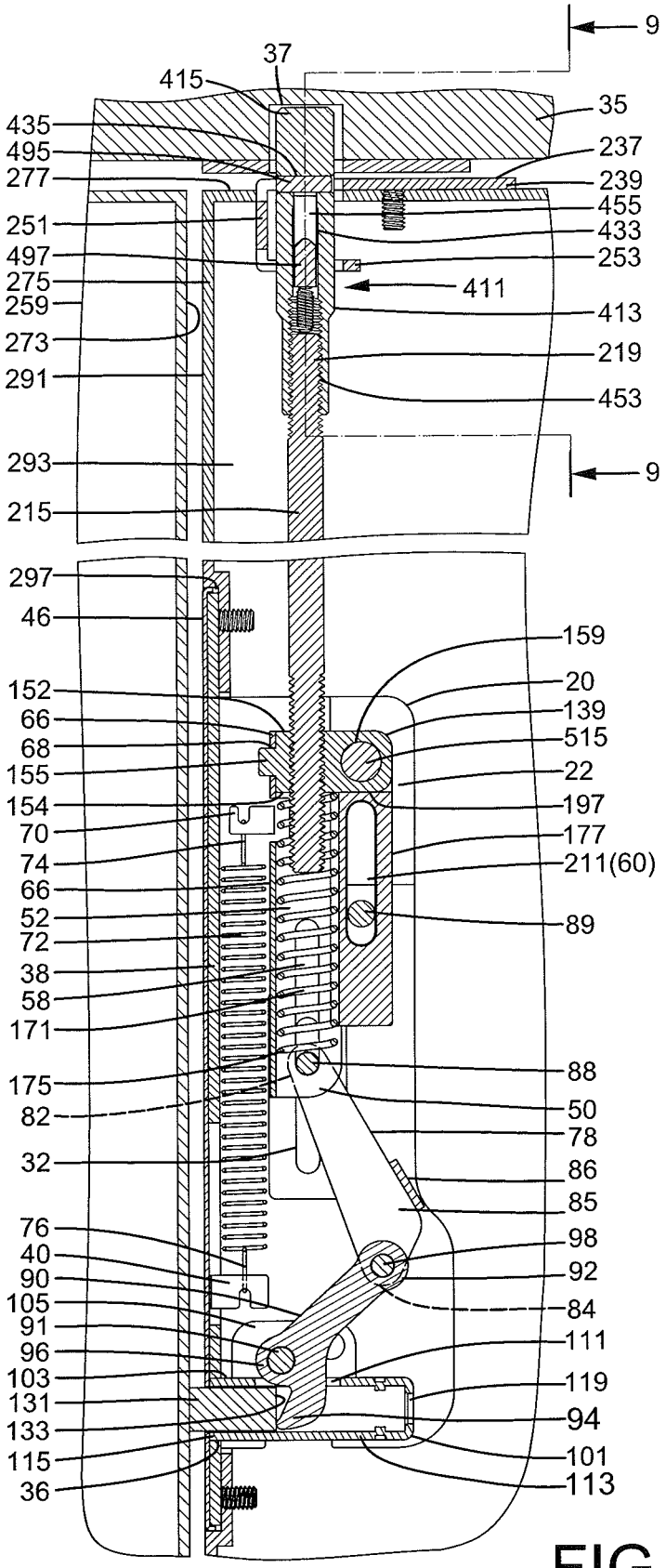
FIG. 8 shows a view similar to FIG. 5, with a primary door closed, and with a latch engaged in a groove in a door frame for the double door.
Figure 9:
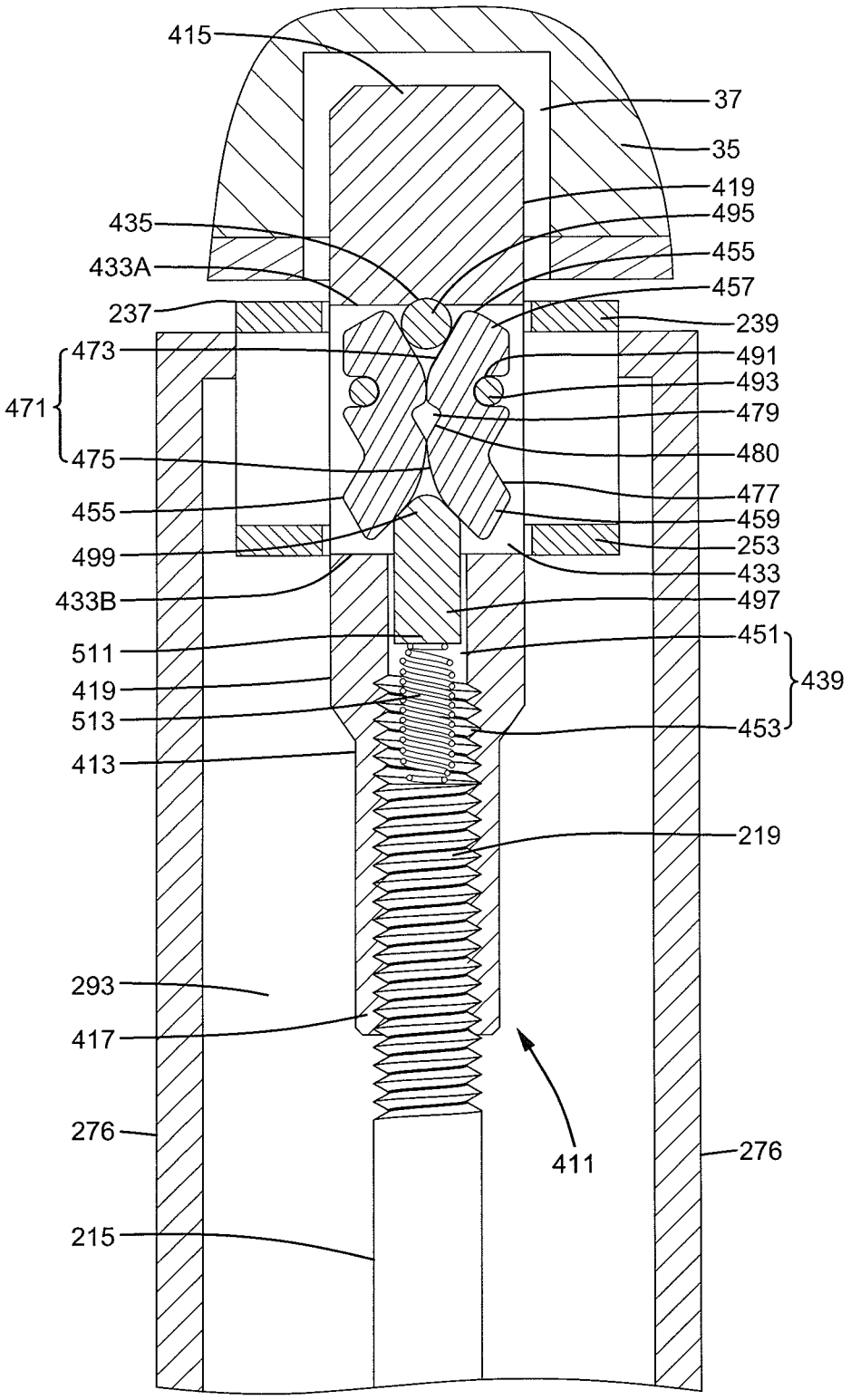
FIG. 9 shows across-sectional view taken along section line 9-9 of FIG. 8.

In the form shown, each latch assembly 10 further includes a first pin 88 extending through movement grooves 32 of sidewalls 22 of base 20 and first sliding grooves 58 of lateral walls 52 of movable member 50. Each latch assembly 10 further includes a second pin 89 extends through first engagement holes 28 of sidewalls 22 of base 20 and second sliding grooves 60 of lateral walls 52 of movable member 50. Thus, movable member 50 is movable along first axis X between a disengagement position (FIG. 5) and an engagement position (FIG. 8). A spacing between lug 70 of movable member 50 in the disengagement position and hooked portion 40 of base 20 is smaller than a spacing between lug 70 of movable member 50 in the engagement position and hooked portion 40 of base 20. Second sliding grooves 60 provide room for movement of second pin 89 while movable member 50 is moving between the engagement position and disengagement position.

According to the form shown, each latch assembly 10 further includes a spring 72 including a first end 74 attached to lug 70 and a second end 76 attached to hooked portion 40, biasing movable member 50 from the engagement position to the disengagement position.

According to the form shown, each latch assembly 10 further includes a follower 78 pivotably connected to movable member 50. Follower 78 includes two arms 85 spaced from each other along second axis Y and a connecting section 86 extending between arms 85. Each arm 85 has first and second ends 82 and 84. First pin 88 extends through first ends 82 of arms 85 of follower 78, allowing follower 78 to pivot about a pivot axis defined by first pin 88. Furthermore, follower 78 is movable together with first pin 88 in a length of each of first sliding grooves 58 and movement grooves 32 along first axis X.

According to the form shown, each latch assembly 10 further includes an actuation member 90 mounted in base 20 and having first and second ends 92 and 94 and a pivotal portion 96 between first and second ends 92 and 94. A third pin 91 extends through second engagement holes 30 of sidewalls 22 of base 20 and pivotal portion 96 of actuation member 90, allowing actuation member 90 to pivot about a pivot axis defined by third pin 91. First end 92 of actuation member 90 is located between arms 85 of follower 78. A push pin 98 is extended through second ends 84 of arms 85 of follower 78 and first end 92 of actuation member 90, allowing follower 78 and actuation member 90 to pivot about a pivot axis defined by push pin 98. Pivotal movement of actuation member 90 causes movement of follower 78 along first axis X.

According to the form shown, each latch assembly 10 further includes a limiting frame 101 fixed between sidewalls 22 of base 20 and having substantially U-shaped cross sections. Limiting frame 101 includes a first wall 103 and a second wall 113 spaced from first wall 103 along first axis X. Limiting frame 101 further includes a connecting wall 119 extending between first and second walls 103 and 113. First wall 103 includes an inner face 103A and an outer face 103B spaced from inner face 103A along first axis X. A slot 111 extends from inner face 103A through outer face 103B. A first engagement protrusion 115 is formed on a distal edge of each of first and second walls 103 and 113. Each of first and second walls 103 and 113 includes two lateral edges spaced along second axis Y. A second engagement protrusion 117 is formed on each lateral edge of second wall 113. Two wings 105 respectively extend from the lateral edges of first wall 103, with each wing 105 having a pivot hole 109.

In the form shown, each first engagement protrusion 115 of limiting frame 101 is engaged with one of first engagement grooves 42 of base 20. Each second engagement protrusion 117 of limiting frame 101 is engaged with one of second engagement grooves 44 of base 20. Thus, first and second walls 103 and 113 of limiting frame 101 are flush with the edges of slot 36. Pivot holes 109 of limiting frame 101 are aligned with second engagement holes 30 of base 20. Third pin 91 extends through pivot holes 109, second engagement holes 30, and pivotal potion 96 of actuation member 90, fixing limiting frame 101 between sidewalls 22 of base 20, with pivotal portion 96 of actuation member 90 located between wings 105, with second end 94 of actuation member 90 extending through slot 111 and received between first and second walls 103 and 113, with first end 92 of actuation member 90 located between first wall 103 of limiting frame 101 and movement grooves 32 of base 20 along first axis X.

According to the form shown, each latch assembly 10 further includes an actuation latch 131 movably received in slot 36 of base 20. Actuation latch 131 includes a base portion 132 having a first end 133 and a second end 137 spaced from first end 133 along third axis Z. Second end 137 of base portion 132 includes a first end portion 136 and a second end portion 136 spaced from first end portion 136 along second axis Y. A wedge 134 is formed on second end 137 and located between first and second end portions 136. Wedge 134 includes substantially triangular cross sections and includes two actuating faces 135 meeting at an edge, with each actuating face 135 having an end intersecting with second end 137, and with actuating faces 135 located between first and second end portions 136 along second axis Y. Actuation latch 131 is located between first and second walls 103 and 113 of limiting frame 101, with base portion 132 located between sidewalls 22 of base 20. A width between first and second end portions 136 along second axis Y is larger than a width of slot 36 of base 20 along second axis Y. Wedge 134 extends through slot 36 of base 20. Actuation latch 131 is movable along third axis Z between a releasing position in which wedge 134 extends out of base 20 (FIG. 5) and a pressing position in which wedge 134 is received in base 20 (FIG. 8). When actuation latch 131 is in the releasing position, second end 137 abuts the inner face of intermediate wall 38 of base 20.

According to the form shown, each latch assembly 10 further includes a locking block 139 mounted between lateral walls 52 of movable member 50. Locking block 139 includes a body 151 having a first surface 152 and a second surface 154 spaced from first surface 152 along first axis X. Locking block 139 further includes third and fourth surfaces 156 and 158 extending between first and second surfaces 152 and 154, with third and fourth surfaces 156 and 158 spaced from each other along third axis Z. A locking hole 153 in the form of a screw hole extends from first surface 152 through second surface 154. However, instead of a through-hole in the form shown, locking hole 153 can be defined in first surface 152 but spaced from second surface 154. A projection 155 is formed on third surface 156, and an engagement portion 157 is formed on fourth surface 158. Engagement portion 157 includes an engagement hole 159 extending along second axis Y. Locking hole 153 is located between projection 155 and engagement hole 159. Projection 155 is engaged in engagement slot 68 of movable member 50, with third surface 156 abutting an inner face of connecting portion 66, with engagement hole 159 of locking block 139 aligned with mounting holes 64 of lateral walls 52 of movable member 50. Locking block 139 is jointly movable with movable member 50 between the engagement position and the disengagement position along first axis X.

According to the form shown, latch assembly 10 further includes a restraining member 177 mounted in movable member 50. Restraining member 177 includes two sides 193 spaced from each other along second axis Y. Restraining member 177 further includes a limiting face 195 that is arcuate and extends between sides 193. Each side 193 includes a first end 179 and a second end 191 spaced from first end 179 along first axis X. Each side 193 further includes a slot 211 between first and second ends 179 and 191. A mounting hole 199 is defined in first end 179 of each side 193, with slot 211 located between second end 191 and mounting hole 199. A space 197 is defined between first ends 179 of sides 193 of restraining member 177 and spaced from slot 211. A protuberance 213 is formed on second end 191 of each side 193 of restraining member 177.

First ends 179 of sides 193 of restraining member 177 are engaged with locking block 139, with engagement portion 157 received in space 197, with engagement hole 159 aligned with mounting holes 199, with each protuberance 213 engaged in one of engagement notch 62 of movable member 50. Second pin 89 extends through first engagement holes 28 of base 20, second sliding grooves 60 of movable member 50 and slots 211 of restraining member 177. Second pin 89 moves in slots 211 while restraining member 177 and movable member 50 jointly move between the engagement position and the disengagement position.

According to the form shown, each latch assembly 10 further includes an engagement pin 515 extending through mounting holes 64 of movable member 50, mounting holes 199 of restraining member 177, and engagement hole 159 of locking block 139. Thus, movable member 50, locking lock 139, and restraining member 177 are connected together by engagement pin 515 and jointly movable along first axis X between the disengagement position (FIG. 5) and the engagement position (FIG. 8).

According to the form shown, each latch assembly 10 further includes a spring 171 mounted between locking block 139 and first pin 88 and received in a space defined between lateral walls 52 of movable member 50 and located between connecting portion 66 of movable member 50 and limiting face 195 of restraining member 177. Spring 171 includes a first end 173 abutting against second surface 154 of locking block 139 and a second end 175 abutting against first pin 88. Spring 171 biases locking block 139 and first pin 88 away from each other along first axis X.

According to the form shown, each latch assembly 10 further includes a connecting rod 215 engaged with locking block 139. Specifically, connecting rod 215 includes a first end 217 having an outer thread engaged with locking hole 153 of locking block 139, allowing joint movement of connecting rod 215 and locking block 139. Connecting rod 215 further has a second end 219.

According to the form shown, each latch assembly 10 further includes a latch 411 connected to second end 219 of connecting rod 215. Latch 411 includes a body 413 having a locking end 415 and an engagement end 417 spaced from locking end 415 along first axis X. Body 413 further includes two first faces 419 spaced from each other along second axis Y. Body 413 further includes two second faces 431 spaced from each other along third axis Z. A transverse groove 433 extends from one of first faces 419 through the other first faces 419 and is located between locking end 415 and engagement end 417 along first axis X. Transverse groove 433 includes an outer end face 433A and an inner end face 433B spaced from outer end face 433A along first axis X. Body 413 further includes an engagement hole 435 and two pivot holes 437. Each of engagement hole 435 and pivot holes 437 extends from one of second faces 431 through the other second face 431 along third axis Z. Engagement hole 435 extends through outer end face 433A of transverse groove 433 and is located between pivot holes 437 along second axis Y. Each pivot hole 437 is located between outer end face 433A and inner end face 433B of transverse groove 433 along first axis X. Body 413 further includes a longitudinal hole 439 extending from an end face of locking end 415 through inner end face 433B of transverse groove 433 along first axis X. Longitudinal hole 439 includes a first portion 451 contiguous to inner end face 433B of transverse groove 433 and a second portion 453 having an inner thread threadedly engaged with second end 219 of connecting rod 215. Body 413 of latch 411 is jointly movable with connecting rod 215 along first axis X between a latching position and an unlatching position.

According to the form shown, latch 411 further includes a stop 495 fixed in engagement hole 435 of body 41. Stop 495 is made of plastic or a metal (such as tin alloy) having a melting point lower than a melting point of body 413. A pivot 493 is mounted in each pivot hole 437.

Figure 5:
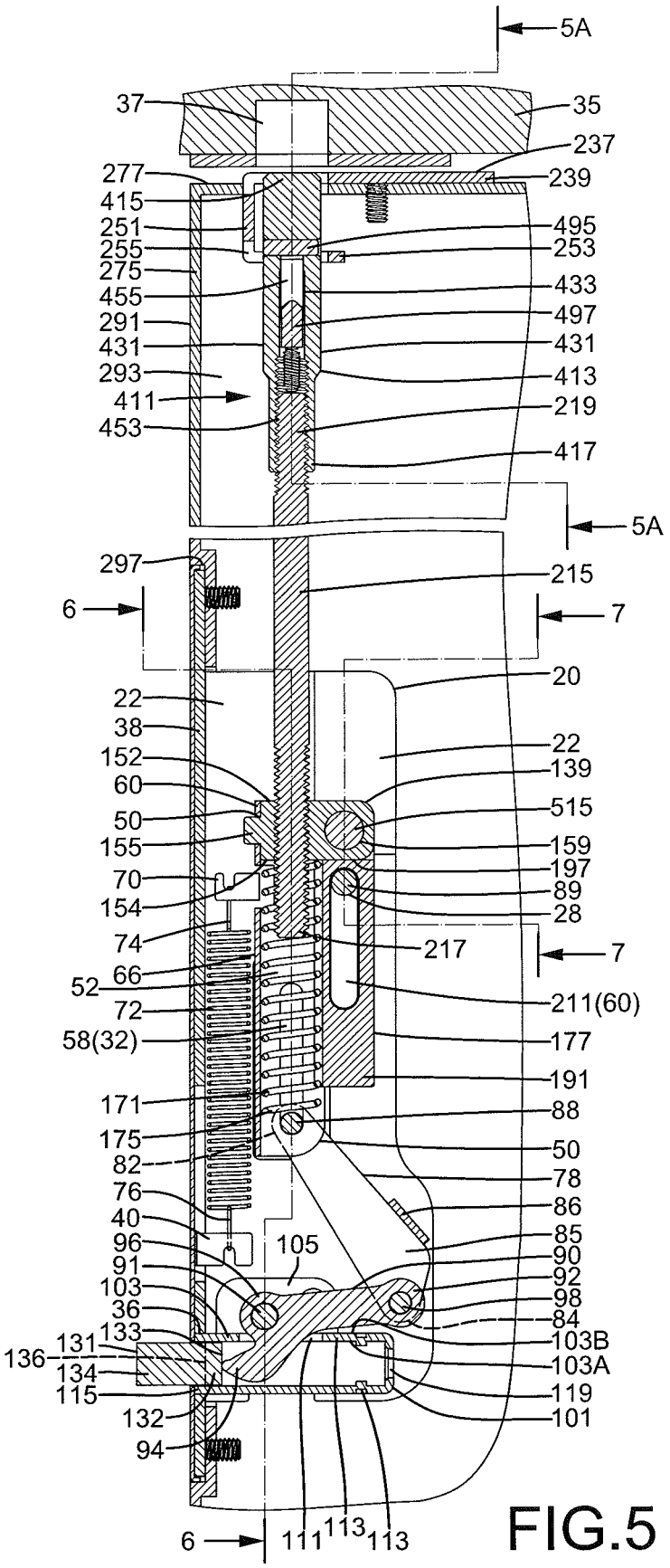
FIG. 5 shows a cross sectional view taken along section line 5-5 of FIG. 4.
Figure 5A:
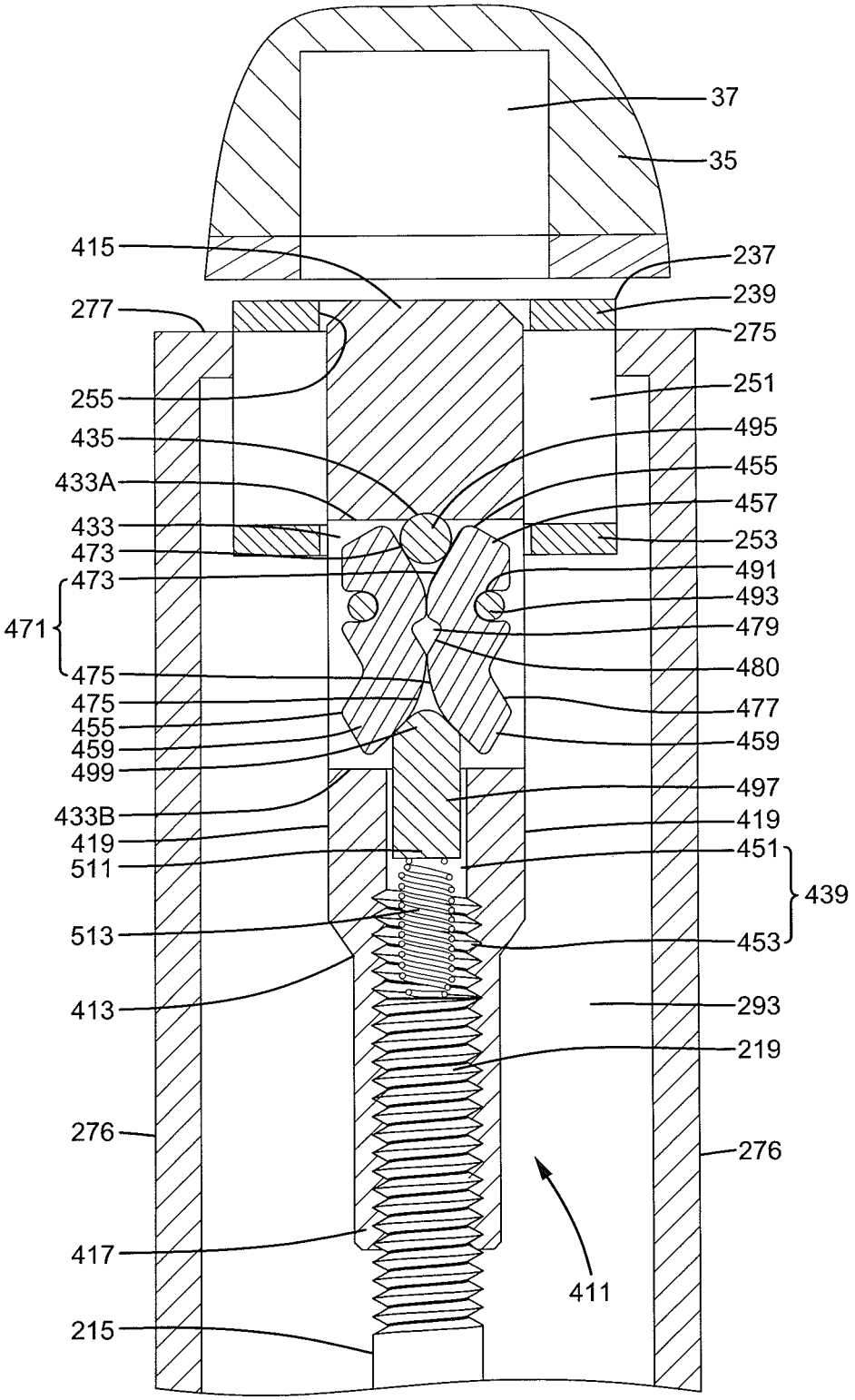
FIG. 5A shows a cross sectional view taken along section line 5A-5A of FIG. 5.
Figure 6:
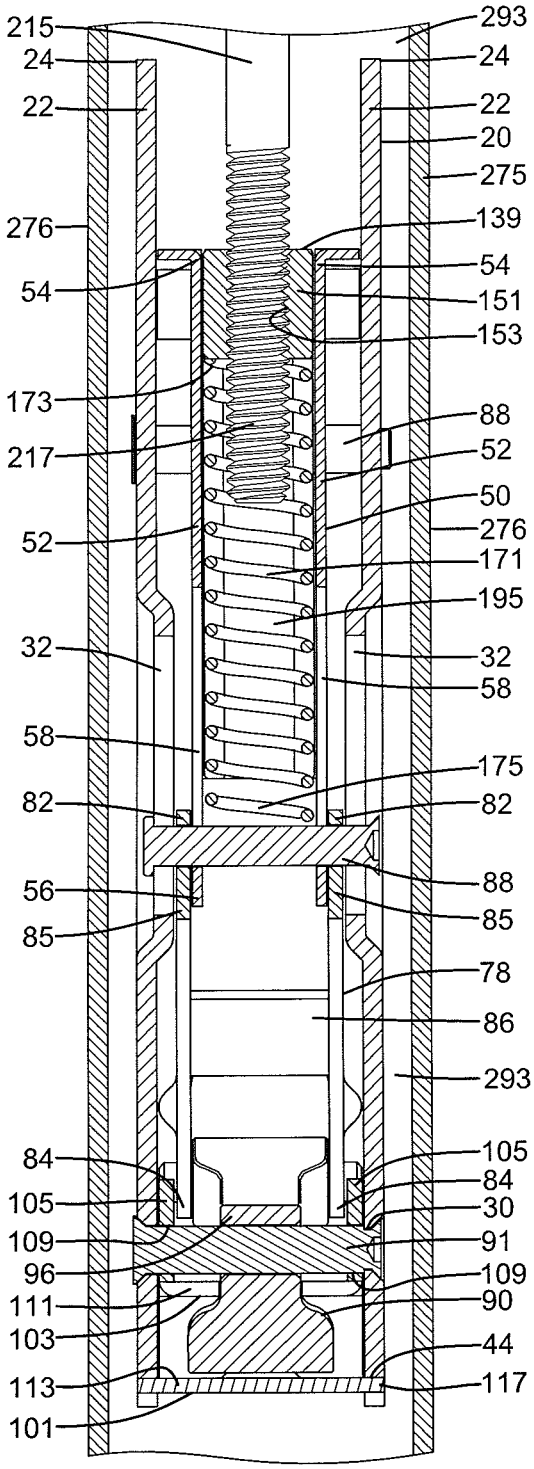
FIG. 6 shows a cross sectional view taken along section line 6-6 of FIG. 5.
Figure 7:
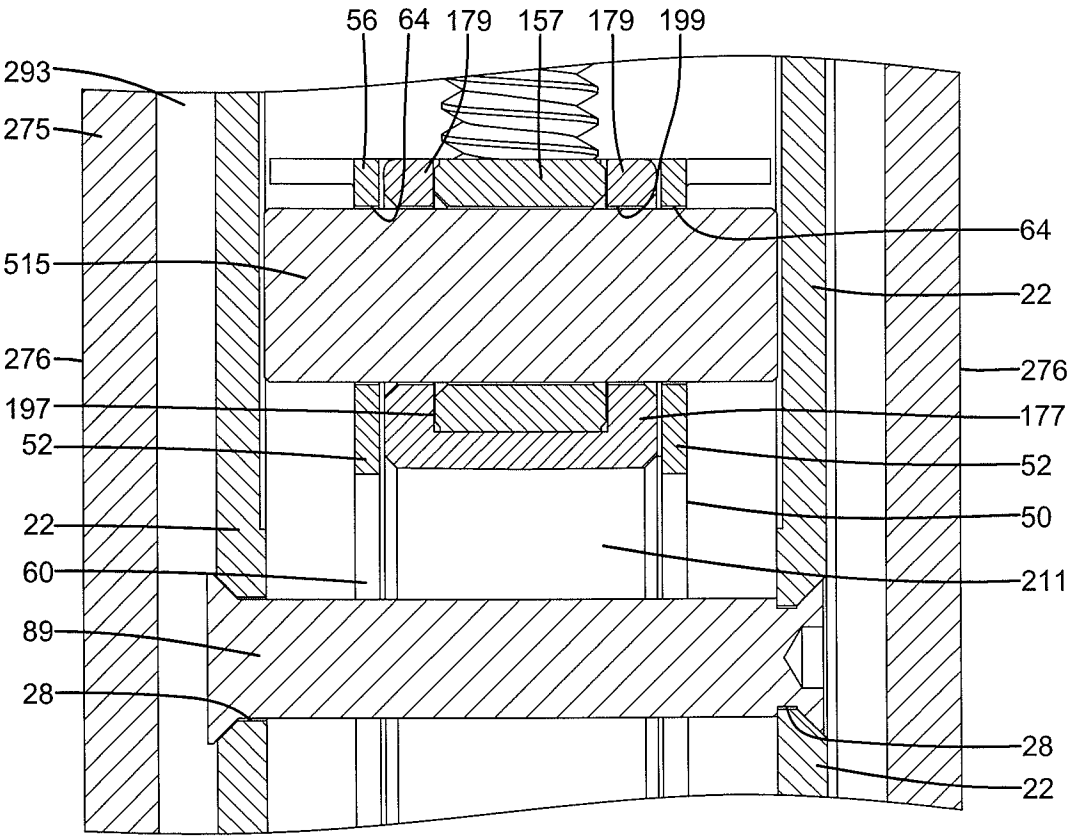
FIG. 7 shows a cross sectional view taken along section line 7-7 of FIG. 7.

According to the form shown, latch 411 further includes two ears 455 pivotably received in transverse groove 433 of body 413. Each ear 455 includes first and second ends 457 and 459 and inner and outer sides 471 and 477 extending between first and second ends 457 and 459. In the form shown, inner side 471 is convex and includes a coupling groove 479 having a limiting face 480. Coupling groove 479 divides inner side 471 into a stop portion 473 and a push portion 475, with coupling groove 479 located between stop portion 473 and push portion 475 along first axis X. A pivotal groove 491 is defined in outer side 477 of each ear 455 and located between first end 457 and coupling groove 479 along first axis X (FIG. 5A).

Figure 10:
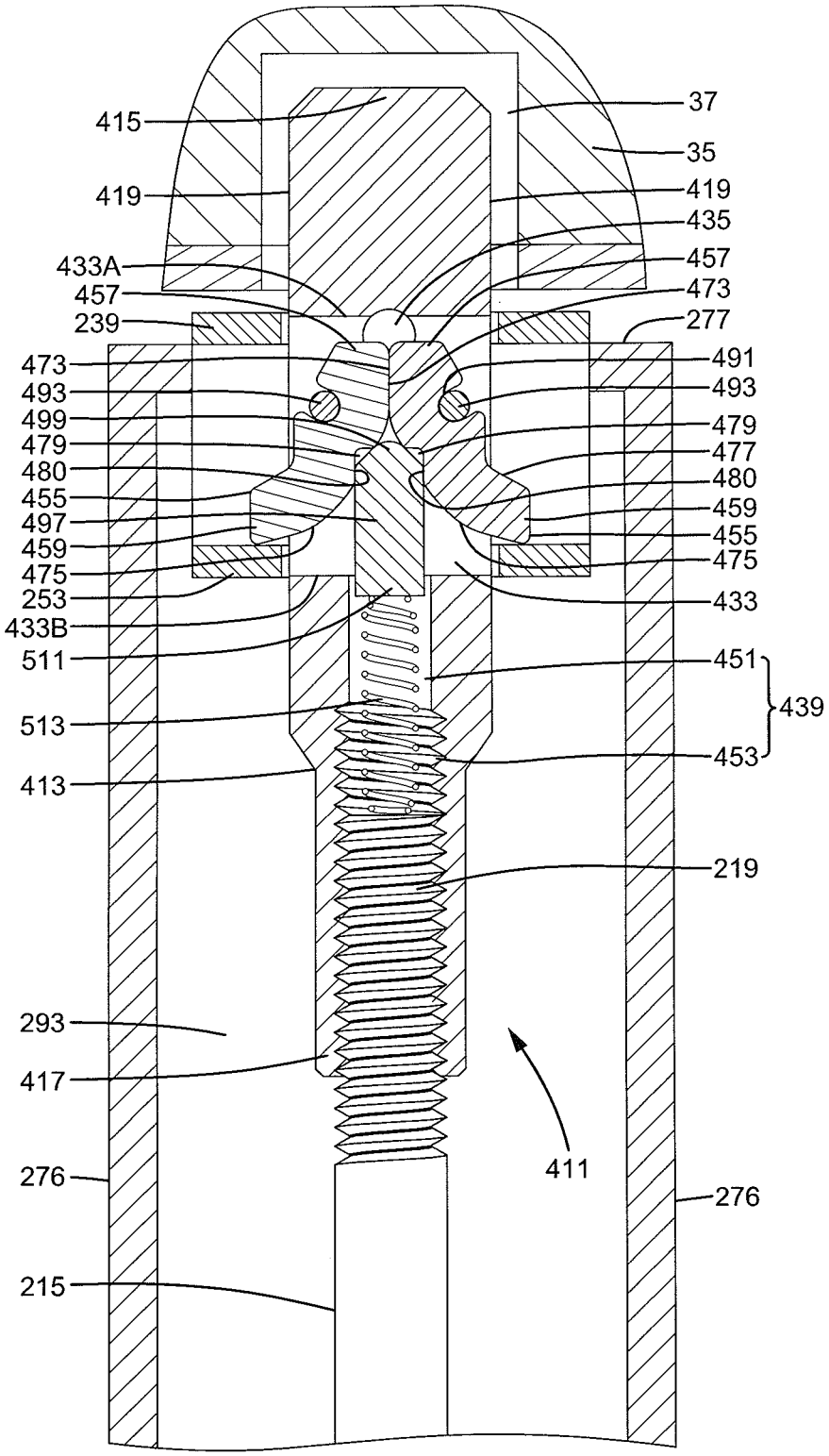
FIG. 10 shows a view similar to FIG. 9, with two ears of the latch moved from storage positions to blocking positions during a fire.

Ears 455 are received in transverse groove 433 of body 413, with each pivot 493 pivotably received in pivotal groove 491 of one of ears 455. Thus, each ear 455 is pivotable about a corresponding pivot 493 between a storage position (FIGS. 5, 5A, and 8) and a blocking position (FIG. 10). When ears 455 are in the storage position, ears 455 are located in transverse groove 433. Stop 495 is located between first ends 457 of ears 455 along second axis Y (FIG. 5A). Furthermore, stop portion 473 of each ear 455 presses against an outer periphery of stop 495. In this case, ears 455 can not pivot towards the blocking position. On the other hand, when ears 455 are in the blocking position, second end 459 of each ear 455 extends out of transverse groove 433 and beyond a corresponding first face 419 (first faces 419 are located between second ends 459 of ears 455 along second axis Y).

According to the form shown, latch 411 further includes a pressing pin 497 slideably received in longitudinal hole 439 of body 413. Pressing pin 497 includes outer and inner ends 499 and 511. Pressing pin 497 is received in first portion 451 of longitudinal hole 439, and outer end 499 of pressing pin 497 faces ears 455. Pressing pin 497 is movable along first axis X between a non-pressing position (FIGS. 5, 5A, 8, and 8) and a pressing position (FIG. 10). Pressing pin 497 in the non-pressing position is located between second ends 459 of ears 455.

According to the form shown, latch 411 further includes a spring 513 mounted in longitudinal hole 439 and between inner end 511 of pressing pin 497 and second end 219 of connecting rod 215. Spring 513 biasing outer end 499 of pressing pin 497 to press against push portions 475 of ears 455. When ears 455 are in the storage position (FIG. 5A), outer end 499 of pressing pin 497 is sandwiched between second ends 459 of ears 455 while stop 495 is sandwiched between first ends 457 of ears 455. Thus, ears 455 are positioned in the storage position, and stop 495 prevents ears 455 from pivoting from the storage position to the blocking position.

Now that the basic construction of latch assemblies 10 has been explained, the operation and some of the advantages of latch assemblies 10 can be set forth and appreciated. In particular, for the sake of explanation, only the detailed operation of upper latch assembly 10 will be described, and it will be assumed that primary door 259 is in an open position and the follower door 275 is in the closed position (FIG. 5). Receiving holes 255 of upper coupling member 237 are aligned with groove 37 of top beam 35 of door frame 31. Note that receiving holes 255 of lower coupling member 237 are aligned with groove 300 in ground 299. End face 273 of primary door 259 is not aligned with end face 291 of follower door 275. Actuation latch 131 of each latch assembly 10 is not pressed and is in the releasing position (FIG. 5). Movable member 50 is in the disengagement position. Latch 411 is in the unlatching position. In this case, second ends 459 of ears 455 are located below third portion 253 of upper coupling member 237 along first axis X.

When primary door 259 is moved to a closed position, end face 273 of primary door 259 is aligned with end face 291 of follower door 275, latch 333 is received in receptacle 294 of follower door 275, end face 273 of primary door 259 presses against one of actuating faces 135 of actuation latch 131, causing actuation latch 131 to move along third axis Z from the releasing position to the pressing position. First end 133 of actuation latch 131 presses against second end 94 of actuation member 90, causing pivotal movement of actuation member 90 about the pivot axis defined by third pin 91. First end 92 of actuation member 90 pushes push pin 98 and, thus, pushes first ends 82 of arms 85 of follower 78, causing pivotal movement of follower 78 about the pivot axis defined by push pin 98. First pin 88 received in movement grooves 32 of base 20 is pushed by first ends 82 of arms 85 of follower 78 to move along first axis X in a direction away from hooked portion 40. Thus, first pin 88 presses against second end 175 of spring 171, causing first end 173 of spring 171 to press against locking block 139, which, in turn, causes movement of movable member 50 via engagement pin 515. Thus, movable member 50, locking block 139, spring 171, engagement pin 515, and restraining member 177 move jointly from the disengagement position (FIG. 5) to the disengagement position (FIG. 8).

While movable member 50 is moving from the disengagement position to the engagement position, first end 74 of spring 72 is pulled by lug 70 of movable member 50. Locking block 139 causes movement of latch 411 from the unlatching position (FIG. 5) to the latching position (FIG. 8) via connecting rod 215. Thus, locking end 415 of latch 411 is engaged in groove 37 in top beam 35. Note that locking end 415 of latch 411 of lower latch assembly 10 is engaged in groove 300 in ground 299. As a result, follower door 275 can not pivot from the closed position to the open position relative to door frame 31. Furthermore, primary door 259 can not be opened, either, because latch 333 of door lock 319 on primary door 259 is engaged in receptacle 294 of follower door 275. Furthermore, when latch 411 is in the latching position, ears 455 of latch 411 is located between first portion 239 and third portion 253 of coupling member 237 along first axis X.

If handle 331 is operated to retract latch 333 from receptacle 294, primary door 259 can be opened to disengage end face 273 of primary door 259 from actuation latch 131. Spring 72 pulls movable member 50 from the engagement position to the disengagement position, and actuating latch 131 moves from the pressing position to the releasing position. Latch 411 is moved from the latching position to the unlatching position, disengaging locking end 415 from groove 37 of top beam 35. Note that latch 411 of lower latch assembly 10 is also moved from the latching position to the unlatching position, disengaging locking end 415 from groove 300 in ground 299. Thus, follower door 275 can be moved to the open position.

In a case that a fire occurs while both of follower door 275 and primary door 259 are in their closed positions (latch 411 is in the latching position), stop 495 melts due to the heat of the fire. Pressing pin 497 is actuated by spring 513 to move from the non-pressing position to the pressing position and presses against the push portions 475 of ears 455, casing pivotal movement of each ear 455 from the storage position to the blocking position. When pressing pin 497 reaches the pressing position, second end 459 of each ear 455 is located outside of a corresponding first face 419 of body 413 of latch 411 (FIG. 10). Stop portions 473 of ears 455 presses against each other, avoiding further pivotal movement of ears 455 and retaining ears 455 in the blocking position. Furthermore, outer end 499 of pressing pin 497 is received in coupling grooves 479 of ears 455, and limiting face 480 of each coupling groove 479 presses against the outer periphery of pressing pin 497, preventing ears 455 from pivoting from the blocking position to the storage position. Thus, ears 455 are retained in the blocking position, with second end 459 of each ear 455 located between first portion 239 and third portion 253 of upper coupling member 237 and pressing against third portion 253.

Figure 11:
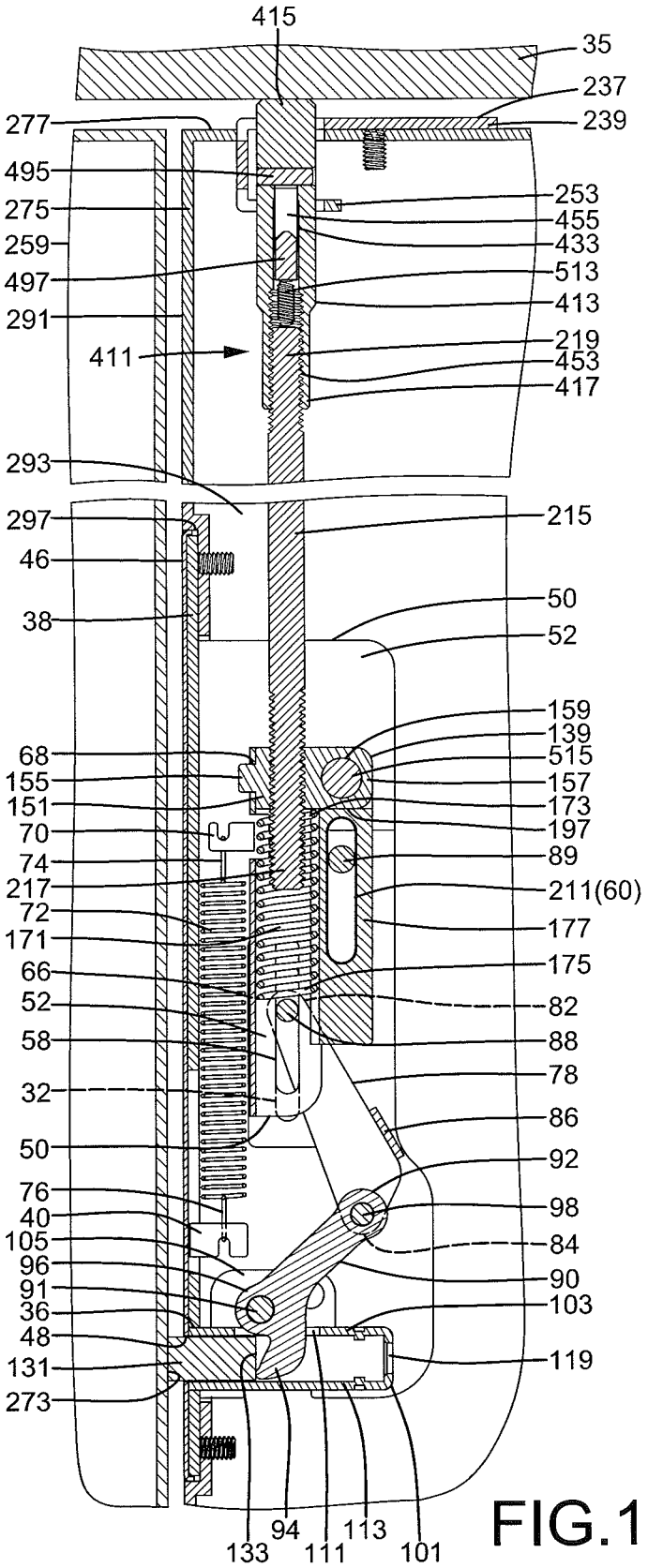
FIG. 11 shows a view similar to FIG. 5, with the latch not aligned with the groove of the door frame, and with the primary door moved to a closed position.

With reference to FIG. 11, in a case that follower door 275 is not exactly in the closed position (i.e., receiving holes 255 of upper coupling member 237 are not aligned with groove 37 in top beam 35, and receiving holes 255 of lower coupling member 237 are not aligned with groove 300 in ground 299), if primary door 259 is moved to the closed position, actuation latch 131 is moved to the pressing position, movement of latch 411 from the unlatching position to the latching position is hindered by top beam 35 (and movement of latch 411 of lower latch assembly 10 from the unlatching position to the latching position is hindered by ground 299). Thus, movable member 50 is retained in the disengagement position, and locking block 139, restraining member 177, spring 171, and engagement pin 515 are not moved. However, first pin 88 moves along first axis X in the direction away from hooked portion 40 and compresses spring 171, causing actuation member 90 to pivot about the pivot axis defined by third pin 91 and causing follower 78 to pivot about the pivot axis defined by push pin 98 without driving latch 411 to the latching position. This avoids damage to latch assembly 10 resulting from improper operation.

By providing ears 455 in latch 411, latch 411 can be retained in the latching position by ears 455 that are pivoted to the blocking position after stop 495 melts during a fire, avoiding spread of the fire by avoid opening of double door 257. Latch 411 can be used on currently available latch assemblies having a structure similar to latch assemblies 10.

Each latch assembly 10 can automatically move latch 411 to the latching position while primary door 259 is moved to the closed position. Furthermore, even if actuation latch 131 of each latch assembly 10 is actuated by primary door 259 while latches 411 are not aligned with grooves 37 and 300, only actuation member 90 and follower 78 are pivoted to cause first pin 88 to compress spring 171. Latch 411, movable member 50, locking block 139, and restraining member 177 are not moved, effectively protecting latch assembly 10 from improper operation. Furthermore, since latch 411 is operatively connected to actuation latch 131, if latch 411 is picked with an intention to move actuation latch 131, movement of actuation latch 131 from the pressing position to the releasing position is hindered by primary door 259, providing an anti-pick function.

Now that the basic teachings of the present invention have been explained, many extensions and variations will be obvious to one having ordinary skill in the art. For example, each ear 455 does not have to include coupling groove 479. In this case, when ears 455 are in the blocking position, pressing pin 497 moves to a position between inner sides 471 of ears 455, and the weights of ears 455 are insufficient to move pressing pin 497 towards the non-pressing position. Thus, ears 455 can be retained in the blocking position. Furthermore, latch 411 can include only one ear 45.

Furthermore, engagement hole 435 can extend from the end face of locking end 415 through outer end face 433A of transverse groove 433 along first axis X. In this case, stop 495 extends along first axis X into engagement hole 435, with a distal end of stop 495 located between first ends 457 of ears 455.

Furthermore, only one latch assembly 10 is sufficient to lock double door 257. In a case that only upper latch assembly 10 is utilized, since the downward moving direction of latch 411 along first axis X from the latching position to the unlatching position is the same as the acting direction of the gravitational force, upper latch assembly 10 does not have to include spring 72, and latch 411 is biased by the gravitational force from the latching position to the unlatching position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch for a latch assembly comprising:

a body including a locking end and an engagement end spaced from the locking end, with the engagement end of the body adapted to engage with a connecting rod of a latch assembly, with the body further including a transverse groove extending along a second axis perpendicular to the first axis, with the body further including a face extending between the locking end and the engagement end, with an engagement hole extending from the face of the body to the transverse groove, with the body further including a longitudinal hole extending from the engagement end to the transverse groove, with the latch movable along the first axis between a latching position and an unlatching position, with the locking end of the latch in the unlatching position adapted to be received in a door, with the locking end of the latch in the latching position adapted to extend out of the door into a groove in a door frame or a groove in a ground;

a stop made of a material having a melting point lower than a melting point of the body of the latch, with the stop received in the engagement hole of the body;

a first ear pivotably received in the transverse groove of the body, with the first ear including first and second ends spaced from each other along the first axis, with the first ear further-including an inner side extending between the first and second ends, with the first ear pivotable between a storage position in the transverse groove and a blocking position partially extending out of the transverse groove;

a pressing pin received in the longitudinal hole and slideable along the first axis between a pressing position and a non-pressing position;

a spring mounted in the longitudinal hole, with the spring biasing the pressing pin to press against the inner side of the first ear and biasing the pressing pin from the non-pressing position to the pressing position, with the first ear in the storage position and the pressing pin in the non-pressing position, the latch is movable between the latching and unlatching positions, with the latch in the latching position and the first ear in the storage position, if the stop is melted by heat, the pressing pin is moved by the spring from the non-pressing position to the pressing position and presses against the inner side of the first ear to pivot the first ear from the storage position to the blocking position, retaining the latch in the latching position;

a second ear pivotably received in the transverse groove of the body, with the second ear including first and second ends spaced from each other along the first axis, with the second ear further including an inner side extending between the first and second ends of the second ear, with the second ear pivotable between a storage position in the transverse groove and a blocking position partially extending out of the transverse groove, with each of the first and second ears further including a coupling groove in the inner side thereof, with the coupling groove having a limiting face, with the coupling groove of the first ear dividing the inner side of the first ear into a stop portion and a push portion, with the coupling groove of the second ear dividing the inner side of the second ear into a stop portion and a push portion, with the first and second ears in the storage positions and the pressing pin in the non-pressing position, an outer end of the pressing in presses against the push portions of the first and second ears, the stop is sandwiched between and pressed against by the stop portions of the first and second ears, and with the first and second ears in the blocking positions, the stop portions of the first and second ears press against each other, the outer end of the pressing in is received in the coupling grooves of the first and second ears, the limiting faces of the first and second ears press against the outer end of the pressing pin, preventing the first and second ears from pivoting from the blocking positions to the storage positions.

2. The latch for a latch assembly as claimed in claim 1, with the transverse groove of each of the first and second ears including an outer end face and an inner end face spaced from the outer end face along the first axis, with the engagement hole extending through the outer end face of the transverse groove along a third axis perpendicular to the first and second axes, with the longitudinal hole of the latch extending from an end face of the engagement end through the inner end face of the transverse groove.

3. The latch for a latch assembly as claimed in claim 2, with the longitudinal hole including a first portion contiguous to the inner end face of the transverse groove and a second portion having an inner thread, with the pressing pin slideably received in the first portion of the longitudinal hole, with the second portion of the longitudinal hole adapted to be threadedly engaged with the connecting rod.

4. A latch assembly comprising:

a base including two sidewalls and an intermediate wall extending between the two sidewalls, with each of the two sidewalls including a movement groove and first and second engagement holes, with the movement groove located between the first engagement hole and the second engagement hole along a first axis, with the intermediate wall including a slot, with the intermediate wall of the base adapted to be mounted to an end face of a follower door of a double door, with the follower door including an interior space, with the two sidewalls adapted to be received in the interior space of the follower door, with the follower door pivotable between a closed position and an open position;

a movable member movably received between the two sidewalls of the base, with the movable member including two lateral walls spaced from each other along a second axis perpendicular to the first axis, with the movable member further including a connecting portion extending between the two lateral walls, with each of the two lateral walls including a first end and a second end spaced from the first end along the first axis, with first and second sliding grooves defined in each of the two lateral walls, with the first sliding groove located between the second sliding groove and the connecting portion along a third axis perpendicular to the first and second axes, with the movement grooves of the two sidewalls of the base aligned with the first sliding grooves of the two lateral walls of the movable member;

a first pin extending through the movement grooves of the two sidewalls of the base and the first sliding grooves of the two lateral walls of the movable member;

a second pin extending through the first engagement holes of the two sidewalls of the base and the second sliding grooves of the two lateral walls of the movable member, with the movable member movable between an engagement position and a disengagement position along the first axis, a follower pivotably connected to the movable member, with the follower including an arm having first and second ends, with the first pin extending through the first end of the arm, allowing the follower to pivot about a pivot axis defined by the first pin;

an actuation member pivotably received in the base and having first and second ends and a pivotal portion between the first and second ends of the actuation member, with the second end of the actuation member facing the intermediate wall of the base;

a locking block mounted between the two lateral walls of the movable member, with the locking block and the movable member jointly movable between the disengagement position and the engagement position;

a first spring mounted between the locking block and the first pin, with the first spring biasing the locking block and the first pin away from each other along the first axis;

a limiting frame fixed between the two sidewalls of the base, with the limiting frame including a first wall and a second wall spaced from the first wall along the first axis, with the limiting frame further including a connecting wall extending between the first and second walls, with the first wall including an inner face and an outer face spaced from the inner face along the first axis, with a slot extending from the inner face through the outer face of the first wall, with the first and second walls fixed to the intermediate wall of the base, with the second end of the actuation member extending through the slot and received between the first and second walls;

an actuation latch movably received in the slot of the base, with the actuation latch including a base portion having first and second ends spaced from each other along the third axis, with a wedge formed on the second end of the actuation latch and having two actuation faces, with the actuation latch movable along the third axis between a releasing position in which the wedge is located outside of the base and a pressing position in which the wedge is received in the base, with the actuation latch adapted to be actuated by an end face of a primary door of the double door, wherein when the follower door is in the closed position and the end face of the primary door is aligned with the end face of the follower door, the end face of the primary door presses against the actuation latch, moving the actuation latch from the releasing position to the pressing position;

a connecting rod including a first end engaged with the locking block and a second end; and a latch including:

a body including a locking end and an engagement end spaced from the locking end along the first axis, with the engagement end of the body engaged with the second end of the connecting rod, with the body further including a transverse groove extending along the second axis perpendicular to the first axis, with the body further including a face extending between the locking end and the engagement end, with an engagement hole extending from the face of the body to the transverse groove, with the body further including a longitudinal hole extending from the engagement end to the transverse groove, with the latch movable along the first axis between a latching position and an unlatching position, with the locking end of the latch in the unlatching position being adapted to be received in the follower door, with the locking end of the latch in the latching position adapted to extend out of the follower door into a groove in a door frame or a groove in a ground;

a stop made of a material having a melting point lower than a melting point of the body of the latch, with the stop received in the engagement hole of the body;

a first ear pivotably received in the transverse groove of the body, with the first ear including first and second ends spaced from each other along the first axis, with the first ear further including an inner side extending between the first and second ends, with the first ear pivotable between a storage position in the transverse groove and a blocking position partially extending out of the transverse groove;

a pressing pin received in the longitudinal hole and slideable along the first axis between a pressing position and a non-pressing position; and a second spring mounted in the longitudinal hole, with the second spring biasing the pressing pin to press against the inner side of the first ear and biasing the pressing pin from the non-pressing position to the pressing position, with the first ear in the storage position and the pressing pin in the non-pressing position, the latch is pivotable between the latching and unlatching positions, with the latch in the latching position and the first ear in the storage position, if the stop is melted by heat, the pressing pin is moved by the second spring from the non-pressing position to the pressing position and presses against the inner side of the first ear to pivot the first ear from the storage position to the blocking position, retaining the latch in the latching position, wherein when the follower door is in the open position, the latch is not aligned with the groove in the door frame or ground, when the follower door is in the closed position, the latch is aligned with the groove in the door frame or ground, wherein when the actuation latch is in the releasing position, the movable member is in the disengagement position, and the latch is in the unlatching position, wherein when the follower door is in the closed position and when the actuation latch moves from the releasing position to the pressing position, the first end of the actuation latch pushes the second end of the actuation member to move the second end of the follower, causing the first pin to push the locking block via the first spring, moving the movable member from the disengagement position to the engagement position while pulling the first spring, thereby moving the locking end of the latch to the latching position to engage with the groove in the door frame or ground, and wherein when the actuation latch is moved from the releasing position to the pressing position while the follower door is not in the closed position, the actuation member actuates the follower via the push pin, moving the first pin in the movement grooves of the base along the first axis and compressing the first spring, retaining the movable member in the disengagement position and retaining the latch in the unlatching position, avoiding damage to the latch assembly.

5. The latch assembly as claimed in claim 4, further comprising:

a second ear pivotably received in the transverse groove of the body, with the second ear including first and second ends spaced from each other along the first axis, with the second ear further including an inner side extending between the first and second ends of the second ear, with the second ear pivotable between a storage position in the transverse groove and a blocking position partially extending out of the transverse groove, with each of the first and second ears further including a coupling groove in the inner side thereof, with the coupling groove having a limiting face, with the coupling groove of the first ear dividing the inner side of the first ear into a stop portion and a push portion, with the coupling groove of the second ear dividing the inner side of the second ear into a stop portion and a push portion, with the first and second ears in the storage positions and with the pressing pin in the non-pressing position, an outer end of the pressing pin presses against the push portions of the first and second ears, the stop is sandwiched between and pressed against by the stop portions of the first and second ears, and with the first and second ears in the blocking positions, the stop portions of the first and second ears press against each other, the outer end of the pressing pin is received in the coupling grooves of the first and second ears, the limiting faces of the first and second ears press against the outer end of the pressing pin, preventing the first and second ears from pivoting from the blocking positions to the storage positions.

6. The latch assembly as claimed in claim 5, with the transverse groove of each of the first and second ears including an outer end face and an inner end face spaced from the outer end face along the first axis, with the engagement hole extending through the outer end face of the transverse groove along a third axis perpendicular to the first and second axes, with the longitudinal hole of the latch extending from an end face of the engagement end through the inner end face of the transverse groove.

7. The latch assembly as claimed in claim 5, with the longitudinal hole including a first portion contiguous to the inner end face of the transverse groove and a second portion having an inner thread, with the pressing pin slideably received in the first portion of the longitudinal hole, with the second portion of the longitudinal hole adapted to be threadedly engaged with the connecting rod.

8. The latch assembly as claimed in claim 4, further comprising:

a coupling member including a first portion, a second portion connected to an end of the first portion, and a third portion connected to the second portion and spaced from the first portion along the first axis, with the first portion of the coupling member adapted to be fixed a top face or a bottom face of the follower door, with the third portion adapted to be received in an interior space of the follower door, with the latch in the unlatching position, the second end of the first ear is spaced from the third portion of the coupling member along the first axis, with the latch in the latching position and the first ear in the blocking position, the second end of the first ear presses against the third portion of the coupling member, preventing the latch from moving from the latching position to the unlatching position.

* * * * *